United States Patent [19]

Villari et al.

[11] 3,994,022

[45] Nov. 30, 1976

[54] PROTECTIVE HELMET WITH LINERS

[75] Inventors: Frank K. Villari, Oak Park; Carl J. Steigerwald, Wauconda, both of Ill.

[73] Assignee: The Kendall Company, Boston, Mass.

[22] Filed: June 5, 1975

[21] Appl. No.: 584,089

[52] U.S. Cl. ..... 2/413

[51] Int. Cl.[2] ..... A42B 3/02; A42B 1/08

[58] Field of Search ..... 2/3 R, 6, 8, 9, 10, 2/177, 202; 273/65 A, 65 B; 137/223, 225, 230; 9/346; 267/113, 117

[56] References Cited

UNITED STATES PATENTS

| | | | |
|---|---|---|---|
| 3,462,763 | 8/1969 | Schneider et al. | 2/3 R |
| 3,600,714 | 8/1971 | Cade et al. | 2/3 R |
| 3,849,801 | 11/1974 | Holt et al. | 2/3 R |

*Primary Examiner*—G. V. Larkin

*Attorney, Agent, or Firm*—Powell L. Sprunger

[57] ABSTRACT

A protective helmet comprising, a shell, and liner means of a flexible material having fluid filled chamber means and a relatively soft inner surface for contacting the wearer's head. The helmet also has a second liner of resilient material positioned intermediate at least a portion of the liner means and the shell.

25 Claims, 27 Drawing Figures

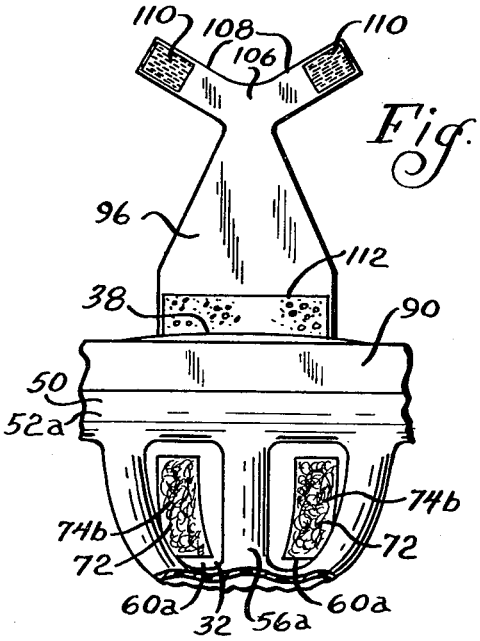
Fig. 11
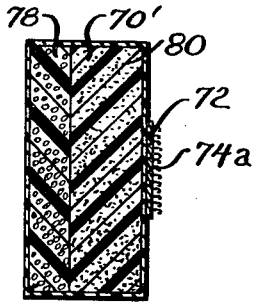
Fig. 10
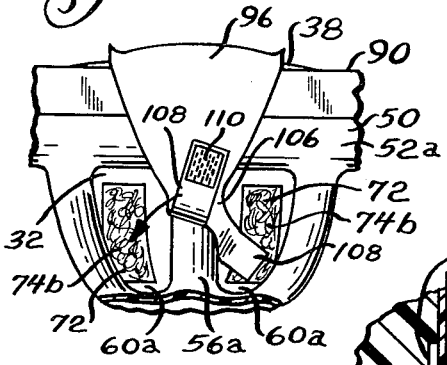
Fig. 12
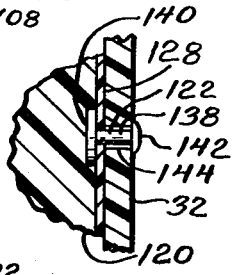
Fig. 15
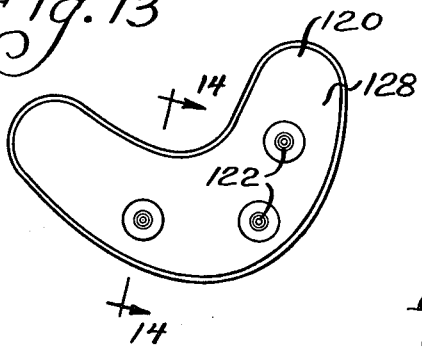
Fig. 13
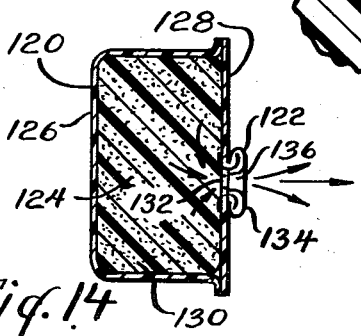
Fig. 14
Fig. 16
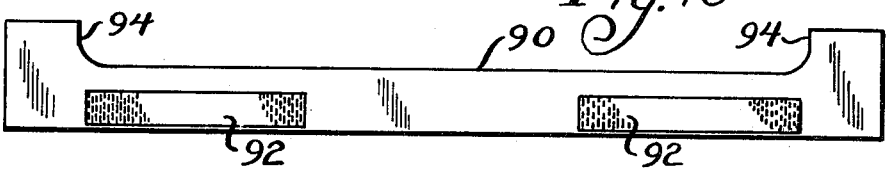
Fig. 17
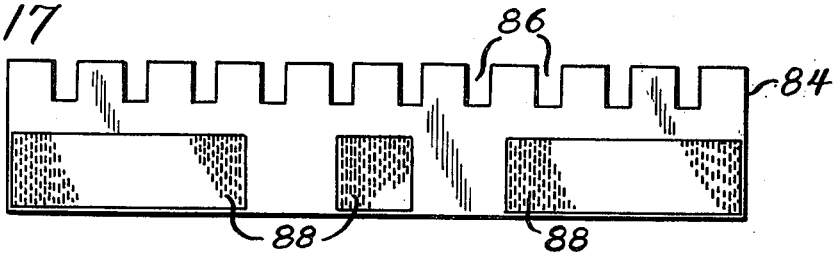

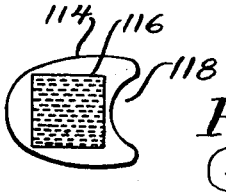
Fig. 18
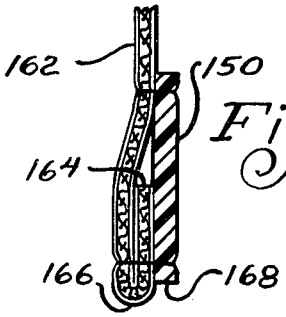
Fig. 21
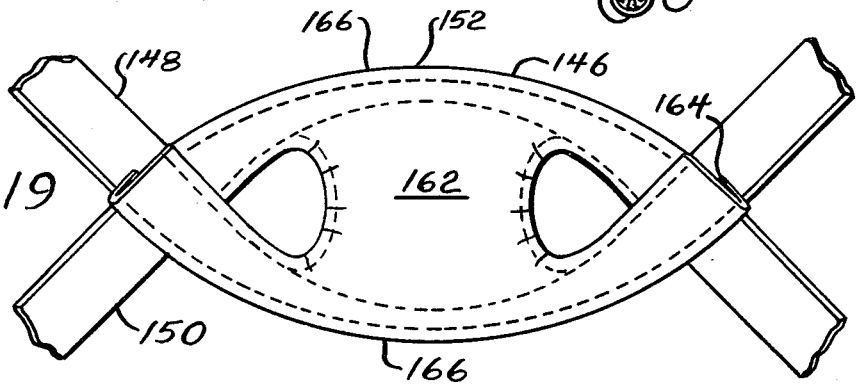
Fig. 19
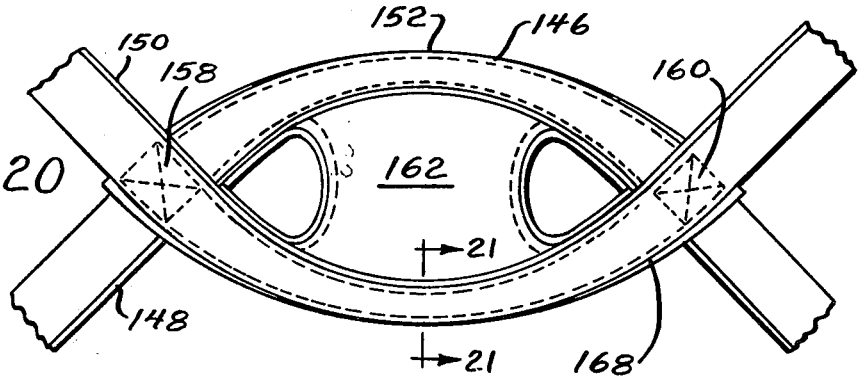
Fig. 20
Fig. 22
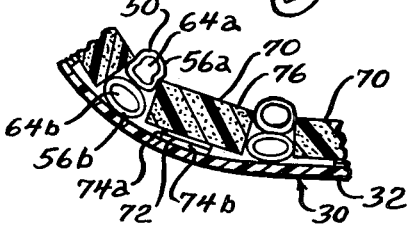
Fig. 23
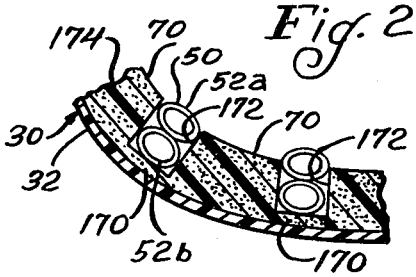

PROTECTIVE HELMET WITH LINERS

BACKGROUND OF THE INVENTION

The present invention relates to protective equipment, and more particularly to protective headgear.

A various assortment of protective headgear or helmets has been proposed in the past for protecting the wearer's head in the event of a collision. Such helmets have been widely utilized by participants in a number of sports, where the possibility of head injury is great, such as football, hockey and baseball, and for other purposes, such as crash helmets. At an earlier time, it was somewhat unclear how much protection the helmets actually afforded to the user, and, if the wearer suffered a head injury in spite of the helmet, it apparently was accepted that the shock to the head resulting from the impact may hve been greater than could reasonably be protected by the headgear.

More recently technology has been applied to determine exactly what happens to the wearer's head when the helmet is subject to impact. In particular, tests have been devised to measure the forces which are actually transmitted to the head responsive to a blow against the helmet. For example, drop tests are currently being used to determine these forces. An accelerometer may be placed in a metal head form, and the helmet to be analyzed is fitted and placed on the form. The helmet and form assembly are then raised to a height above a striking surface, after which the assembly is dropped against the surface, with information from the accelerometer being recorded during this time. Of course, the assembly may be adjusted to select the desired impact point on the helmet. The data from the input axis of the accelerometer may be translated to the vertical drop axis to determine the forces which are transmitted through the helmet to the form. In this manner, a given helmet may be analyzed to learn whether it will perform adequately under conditions for use.

It has been found that in many cases current helmets do not afford the amount of protection expected or desired. Accordingly, a considerable amount of effort has been expended to make protective headgear which laboratory tests demonstrate provide the wearer a maximum amount of protection. Additionally, other factors must be considered in arriving at a totally satisfactory helmet.

First, the helmet should be properly fitted for the wearer during use, or the completely satisfactory test results may vary from the actual conditions when the helmet is worn in the field. Proper fitting of the helmets has been fairly difficult to attain due to the numerous head sizes which must be fitted. Of course, helmets could be tailor made for an individual, but as a practical matter, such a procedure proves unnecessarily burdensome from a standpoint of convenience, time, and cost. Alternatively, it is desirable that the helmets may be adjustable throughout a range of sizes, particularly if the desirable force dissipating characteristics of the helmets are not compromised.

Additionally, the helmet should be comfortable when worn. If the inner portion of the helmet which contacts the wearer's head is too hard, the wearer may suffer headaches or other discomfort as a result of use, and the wearer may refuse to utilize the headgear in spite that it may be superior in all other respects. As will be seen below, the protective headgear of the present invention solves the above difficulties, and provides a helmet which is superior from the standpoint of force dissipation, comfort and fit.

SUMMARY OF THE INVENTION

A principle feature of the present invention is the provision of a protective helmet which has improved energy adsorbing capabilities to dissipate forces applied against the helmet.

The helmet of the present invention comprises, a shell, liner means of flexible material having fluid filled chamber means and an inner surface for contacting the wearer's head, and a liner of resilient material positioned intermediate at least a portion of the liner means and the shell.

A feature of the present invention is that the liner means and resilient liner co-operate to dissipate varying levels of forces applied against the shell.

Another feature of the invention is that the liner means has a relatively soft conformable and confortable inner surface for contacting the wearer's head.

Yet another feature of the invention is that the liner means may be inflated to comfortably fit the helmet to a relatively wide range of head sizes without loss of protection to the wearer.

A feature of the invention is that in one embodiment the liner means may have a single inner liner defining a relatively soft inner surface for the wearer's head, and the resilient liner may extend throughout a substantial inner portion of the shell intermediate the first liner and the shell.

In another embodiment the liner means has a first inner liner of flexible material having first fluid filled chamber means, and a second liner of flexible material positioned intermediate the first liner and the shell and having second fluid filled chamber means at least partially located intermediate the first chamber means and the shell. The second liner has a lower end spaced above a lower end of the first liner at least partially around the shell. The resilient liner is positioned intermediate the lower end of the first liner and the shell, with the resilient liner extending at least partially around the shell in the space defined below the second liner.

A feature of the invention is that the flexible and resilient liners co-operate to dissipate varying levels of forces applied against the shell and protect the wearer against impact.

Another feature of the invention is that the flexible and resilient liners may be readily within and removed from the shell.

Further features will become more fully apparent in the following description of the embodiments of this invention and from the appended claims.

DESCRIPTION OF THE DRAWINGS

In the drawings:

FIG. 10 is a sectional view of an embodiment of the retainer pad of FIG. 9;

FIG. 11 is a fragmentary inner view of a front portion of the helmet, and showing an end of a sweat band before being positioned inside of the helmet;

FIG. 12 is a fragmentary inner view of the helmet of FIG. 11 showing the sweat band as partially secured to an inner portion of the helmet;

FIG. 13 is a plan view of a jaw pad for the helmet of FIG. 1;

FIG. 14 is a sectional view of the jaw pad taken substantially as indicated along the line 14—14 of FIG. 13;

FIG. 15 is a fragmentary sectional view showing an embodiment of securing means for the jaw pad of FIGS. 13 and 14;

FIG. 16 is a plan view of a front pad for the helmet of FIG. 1;

FIG. 17 is a plan view of a rear pad for the helmet of FIG. 1;

FIG. 18 is a plan view of an upper retainer pad for the helmet of FIG. 1;

FIG. 19 is a fragmentary top plan view of a chin strap for the helmet of FIG. 1;

FIG. 20 is a fragmentary bottom plan view of the chin strap of FIG. 19;

FIG. 21 is a fragmentary sectional view of the chin strap taken substantially as indicated along the line 21—21 of FIG. 20;

FIG. 22 is a fragmentary sectional view taken substantially as indicated along the line 22—22 of FIG. 1;

FIG. 23 is a fragmentary sectional view of another embodiment of the helmet;

DESCRIPTION OF THE PREFERRED EMBODIMENTS

Figure 1:
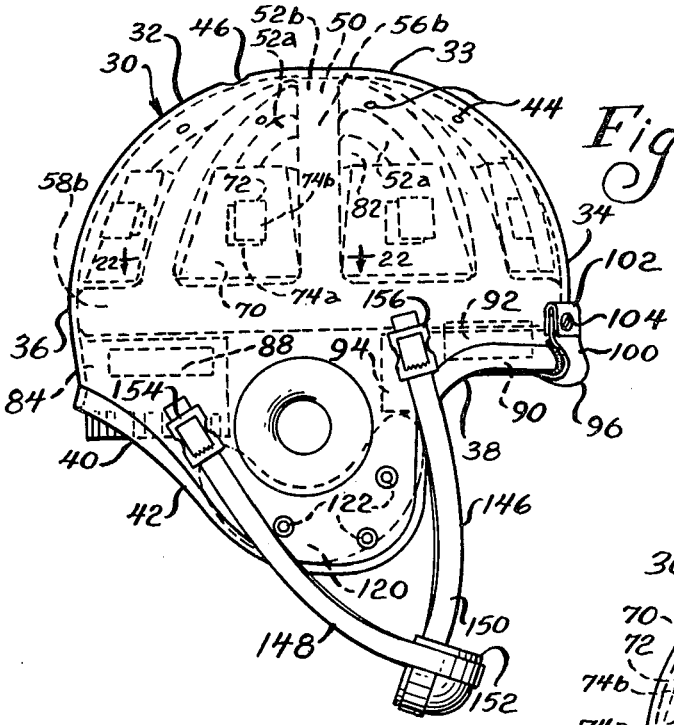
FIG. 1 is a side elevational view of a protective helmet or headgear.
Figure 2:
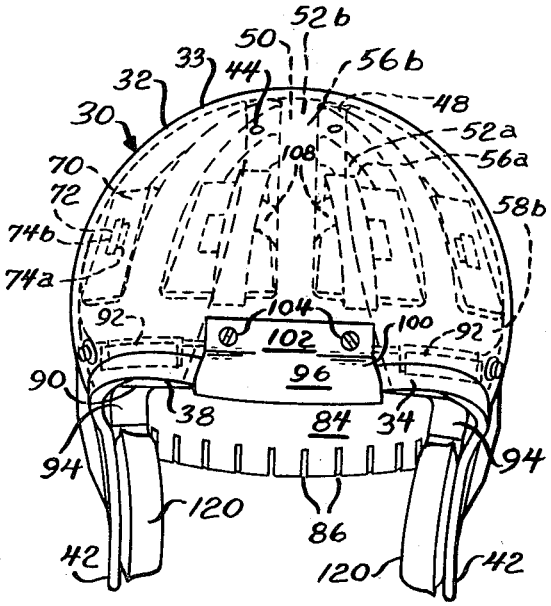
FIG. 2 is a front elevational view of the helmet of FIG. 1.
Figure 3:
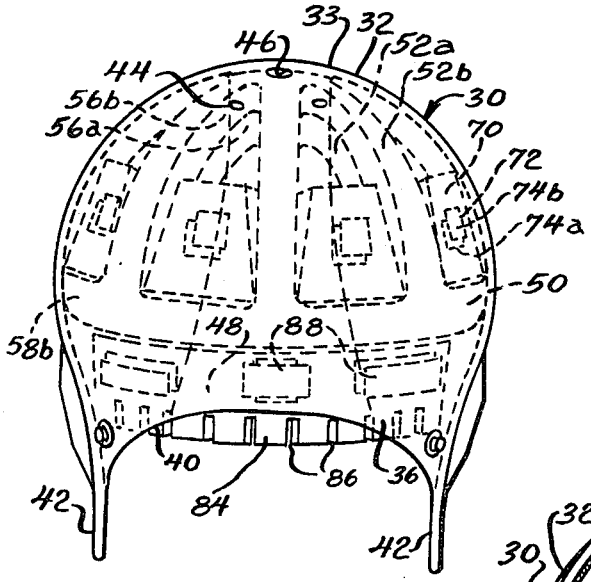
FIG. 3 is a rear elevational view of the helmet of FIG. 1.
Figure 4:
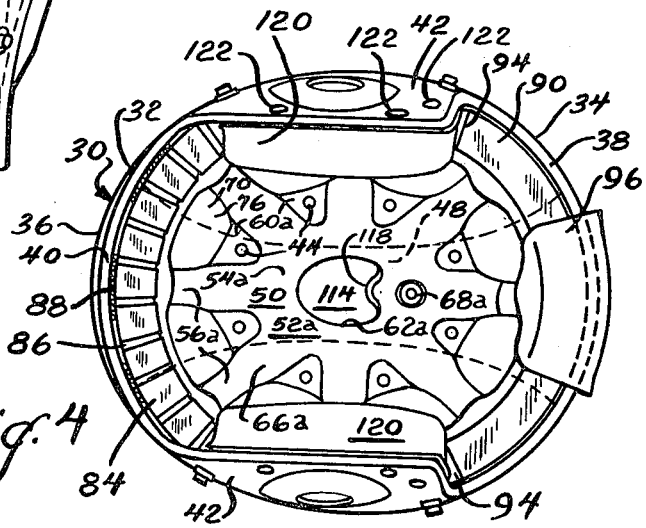
FIG. 4 is a bottom plan view of the helmet of FIG. 1.

Referring now to FIGS. 1–6, there is shown a protective helmet generally designated 30. Although the helmet 30 is shown in the form of a football helmet, it will be understood that the principles of the invention may be utilized in connection with any other suitable headgear, such as hockey helmets, baseball helmets, crash helmets, or other headgear where protection of the head is desired. As shown, the helmet 30 has an outer shell 32 which is preferably made of a relatively rigid material, such as a polycarbonate alloy, a rigid thermoplastic, or a thermosetting resin. The shell 32 has an upper central portion 33, a front portion 34, a rear portion 36, a lower front edge 38, a lower rear edge 40, and a pair of ear protectors 42. The shell 32 also has a plurality of ventilating apertures 44 extending through and spaced around an upper portion of the shell, and an opening 46 extending through the shell which will be further described below. As best shown in FIG. 2–4, the shell 32 may include a region 48 of increased thickness in the longitudinal central area of the helmet or other area of the helmet, such as in the ear protectors 42, to provide additional reinforcement to the shell where holes may be placed in the shell.

Figure 6:
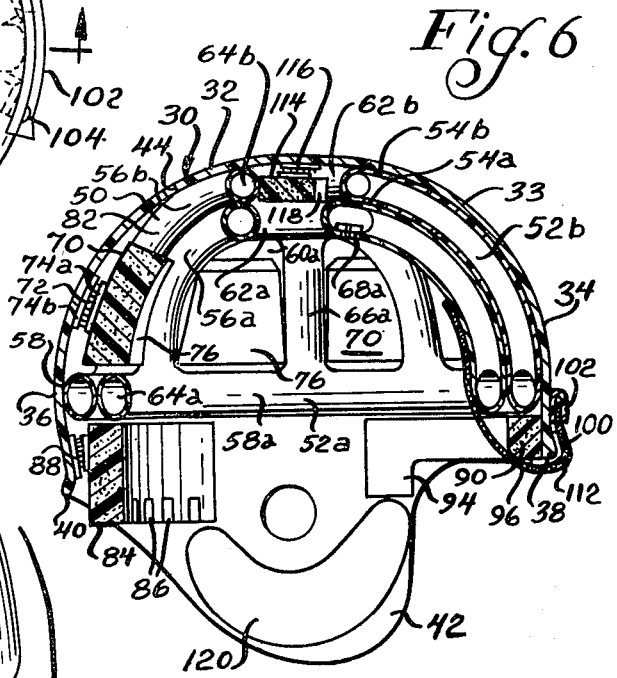
FIG. 6 is a sectional view taken substantially as indicated along the line 6—6 of FIG. 5.
Figure 7:
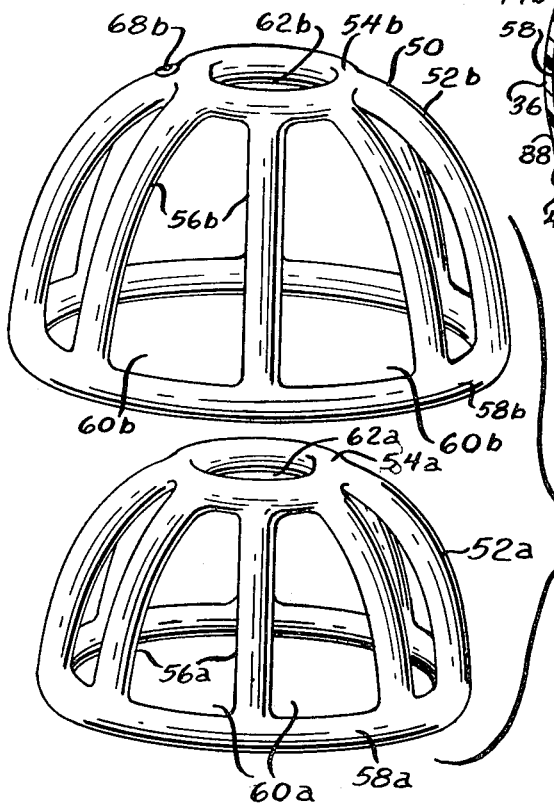
FIG. 7 is an exploded perspective view of nestable liners for the helmet of FIG. 1.
Figure 8:
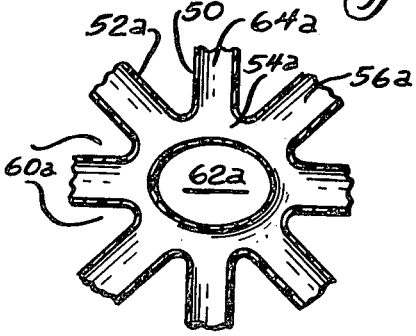
FIG. 8 is a fragmentary sectional view of an upper central portion of one of the liners of FIG. 7.

The helmet 30 also has a flexible liner means or cradle 50 positioned in the shell 32 to dissipate forces applied against the helmet. Referring to FIGS. 6-8, the liner means 50 has a pair of first and second nestable flexible liners or cushions **52*a* and 52*b*, respectively. The first and second liners 52*a* and *b* respectively have a hollow annular member 54*a* and 54*b* adjacent an upper central portion of the respective liner, a plurality of hollow spaced spoke members 56*a* and 56*b* extending from and communicating with the annular member 54*a* or *b* of the respective liner, and a hollow rim 58*a* and 58*b* extending peripherally around a lower end of the respective liner and communicating with the respective spoke members 56*a* or *b*. As shown, side walls of the spoke members 56*a* and *b* and rims 58*a* and *b* define a plurality of openings 60*a* and 60*b* having the general shape of isosceles triangles extending through the respective liner. Aslo, the annular members 54*a* and *b* define generally circular shaped openings 62*a* and 62*b*extending through the upper central portion of the respective liner, with the sidewalls of the liners defining the openings 62*a* and *b*** preventing overinflation or bulging of the upper central portions of the liners.

As best shown in FIGS. 6 and 8, the hollow first liner **52*a* defines first chamber means 64*a* communicating between the annular member 54*a*, the spoke members 52*a*, and the rim 58*a*. Similarly, the second liner 52*b* defines second chamber means 64*b* communicating between the annular member 54*b*, the spoke members 56*b*, and the rim 58*b*. In a preferred form, the first and second chamber means 64*a* and *b* of the first and second liners 52*a* and *b*, respectively, are inflated with a gas, such as air, although the second chamber means 64*b* of the second liner 52*b*** may be filled with a liquid to provide additional rigidity to the second liner, if desired.

Figure 5:
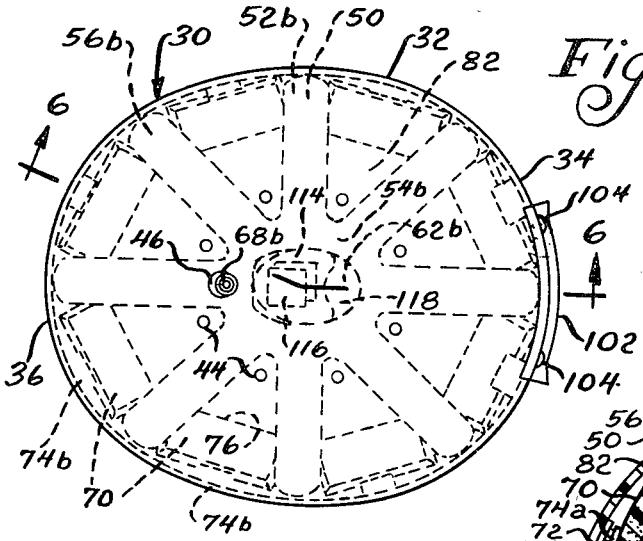
FIG. 5 is a top plan view of the helmet of FIG. 1.

As best shown in FIG. 6, the first liner **52*a* is nested within the second liner 52*b*, with the spoke members 56*a* and *b*, annular members 54*a* and *b*, and rims 58*a* and *b* of the two liners 52*a* and *b*, as well as the first and second chamber members, being generally in alignment. In this configuration, the openings 60*a* and *b* and 62*a* and *b* of the two liners are also in alignment, such that the openings extend completely through the liner means 50. As will be seen below, the inner liner 52*a* defines a soft conformable inner surface 66*a* for contacting the wearer's head. As shown in FIGS. 4 and 6, the first liner 52*a* has lower valve means 68*a* of known type for inflating the first chamber 64*a* through the inside of the helmet, while the second liner 52*b* has upper valve means 68*b* for inflating the second chamber 64*b* through the opening 46 in the shell 32, as illustrated in FIG. 5. The first liner 52*a* may be removably positioned within the second liner 52*b***, and may be secured to the second liner, if desired, by suitable means, such as adhesive, hook and loop strips, or bands extending around the spoke members of the nested liners.

In a preferred form, the liners **52*a* and *b* are rotomolded, and are made from any suitable flexible or elastic material, such as polyvinyl chloride plastisol, ethylene vinyl acetate, polyethylene, or liquid polyurethane. Preferably, the inner first liner 52*a* has a durometer hardness less than the durometer hardness of the second liner 52*b*, although rigidity may be added to the second liner by filling it with liquid. In a suitable structure of the liners, the inner liner 52***a* has a shore A hardness in the range of 45–55, while the shore A hardness of the second liner 52*a* may be in the range of 75–90. If both liners are inflated with a gas, the modulus of elasticity of the inner liner is preferably less than that of the outer liner, such that the inner liner provides a relatively soft conformable inner surface 66*a* for contacting the wearer's head in a comfortable manner. The inner liner 52*a* readily compresses and absorbs energy in the helmet, while providing continued comfort to the wearer, resulting from impacts of relatively low force levels against the shell. The second liner 52*b* provides a more rigid structure to dissipate higher level forces applied against the shell. Thus, the liners 52*a* and *b* co-operate to absorb energy resulting from impacts against the shell of varying force levels, with the liners compressing or deforming differing amounts at the point of impact, such that the forces are dissipated in an improved manner to protect the wearer while providing continued comfort to the wearer.

Figure 9:
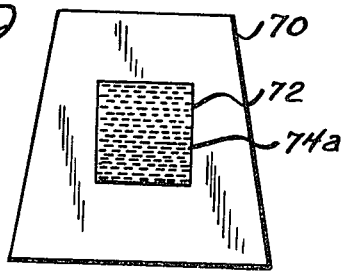
FIG. 9 is a plan view of a retainer pad for the helmet of FIG. 1.

Referring now to FIGS. 6 and 9, there is shown a plurality of resilient retainer pads 70 having a generally trapezoidal shape. The retainer pads 70 may be made of any suitable material, such as a closed cell polyvinyl chloride foam of medium density, for example, Ensolite, a trademark of Uniroyal, or, Rubatex, a trademark of Great American Industries. The pads 70 may have their outer surfaces treated to provide washable surfaces of the pads, for example, by dipping the pads in a suitable material, such as a liquid vinyl, urethane, or latex.

As illustrated in FIGS. 1–6 and 22, a plurality of the retainer pads 70 are positioned in the alignment openings 60*a* and *b* of the first and second liners 52*a* and *b*, with the enlarged portion of the pads being located adjacent the bases of the triangular shaped openings 60*a* and *b*. The pads 70 may be releasably attached to the inside of the shell 32 by suitable securing or fastening means 72 to maintain the pads 70 in place between the spoke members 56*a* and *b* of the first and second liners 52*a* and *b*. The fastening means 72 may comprise a hook and loop arrangement of known type, such as a pair of interengaging hook and loop strips 74*a* and 74*b*, with one strip 74*a* being secured to a back surface of the pads 70, and with the other strip 74*b* being secured to the inner surface of the shell 32. The pads 70 may be attached in the liner openings by passing the pads through the openings and engaging the strips 74*a* on the pads against the strips 74*b* on the shell to interengage the strips of the fastening means 72. The pads 70 may be removed from the openings by pulling on the upper ends of the pads to release the strips 74*a* on the back of the pads from the strips 74*b* on the inside of the shell.

As shown in the drawings, each of the retainer pads 70 extend between adjacent spoke members 56*a* and *b* of the liner means 50, such that the inclined sides of the pads abut against side walls of the spoke members defining the openings 60*a* and *b* of the liner means 50. Since the retainer pads 70 are secured to the shell 32, the pads prevent rotational movement or slippage of the liners 52*a* and *b* within the shell 32. Also, the sides of the pads 70 frictionally engage the spoke members 56*a* and *b*, and the pads 70 prevent upward movement of the shell 32 relative the liner means 50. Accordingly, the liners 52*a* and *b* are held firmly in place by the pads 70 within the shell. In this regard, it should be noted that the pads 70 extend a sufficient distance inwardly from the shell to engage side walls of the spoke members 56*a* of the inner first liner 52*a*, although the inner surfaces 76 of the pads are spaces slightly from the inner surface 66*a* of the liner means 50.

The retainer pads 70 also confine the spoke members 56*a* and *b* of the first and second liners 52*a* and *b* at a location intermediate the pads 70. Thus, the pads limit the amount of expansion permitted by the spoke members intermediate the pads, and facilitate the liners in absorbing energy from an impact. When a force is applied against the shell, particularly in the region of the pads 70, the first and second liners 56*a* and *b* deform somewhat and the fluid in the chambers is compressed in the region of the impact. However, since expansion of the liners is confined in this area by the pads 70, deformation of the liners is reduced, and the liners provide greater impact resistance or cushioning effect in this region. Similarly, if the force is applied to an upper part of the shell 32, fluid passes from the region of the impact toward the lower portion of the liners, and the pads 70 limit expansion of the spoke members to obtain greater resistance to fluid compression in the region of the blow. In this manner, the retainer pads 70 provide additional buoyancy or resiliency to the liner means in order to dissipate forces applied against the shell.

As previously noted, the inner surfaces 76 of the retaining pads 70 are spaced slightly from the inner surface 66*a* of the first liner 52*a*. If a particularly hard impact is applied against the shell, such that the inner surface 66*a* of the liner 52*a* is depressed below the inner surfaces 76 of the pads 70, the retainer pads 70 then serve to absorb energy of the blow. In this case, the retainer pads 70 cushion the blow, and prevent the wearer's head from deforming the liners to a location adjacent the inner surface of the shell 32. In this manner, the first and second liners 52*a* and *b* and retainer pads 70 co-operate to absorb energies resulting from a blow to the helmet. At relatively low impact levels, the soft inner liner 52*a* cushions these blows without the inner surface 66*a* of the inner liner being depressed to a position below the inner surfaces 76 of the pads 70, although, in this instance, the second liner 52*b* may be slightly compressed and contributes in dissipating such forces. At higher level impacts, the more rigid second liner 52*b* provides a second level of energy absorption to dissipate such forces. If the impact is of sufficient magnitude, the inner surface 66*a* of the liner means 50 may be depressed below the inner surfaces 76 of the retaining pads 70 in the region of the blow, and the liners and pads 70 co-operate to absorb the great amount of energy from this blow. Since the pads 70 confine the spoke members 56*a* and *b* of the liners intermediate the pads, the pads cause a smooth transition of energy absorption by the liner means itself and by the liner means in combination with the retainer pads 70. Throughout this time, the inner liner 52*a* provides a soft comfortable surface for the wearer's head, and the retainer pads 70 are made of a relatively soft material to also provide a comfortable surface for the head when they are contacted as a result of a relatively hard blow to the helmet.

Another embodiment of the retainer pads is illustrated in FIG. 10, in which like reference numerals designate like parts. As before, the retainer pads 70' may have a generally trapezoidal shape, fastening means 72 for securing the pads to the inner surface of the shell, and a washable surface or coating. In this embodiment, the pads 70' have a first inner section 78 relatively soft resilient material for contacting the wearer's head, such as the material described in connection with the pads of FIG. 9, and a second outer section 80 of relatively stiff resilient material. The section 80 may be made of any suitable material, such as a rubber and polyvinyl chloride foam composition, for example, a material distributed under the trademark De Cello by David Freeland and Associates, Inc. of Detroit, Michigan. The pads 70' of FIG. 10 provide the helmet with a still higher level of energy absorption capability. When the pads 70' are contacted more lightly by the wearer's head, the relatively soft inner section 78 sufficiently absorbs shock in the helmet. However, when an extremely hard impact is applied against the shell and the wearer's head engages against the retainer pads 70' with a relatively high force, the second stiff sections 80 of the pads absorb energy from the blow, while the soft inner sections 78 of the pads cushion the wearer's during the hard blow.

As illustrated in FIGS. 4, 5, 6, and 18, the helmet 30 also has a resilient pad 114 which is releasably positioned in the openings 62*a* and *b* of the liner means 50. The pad 114 may be made of any suitable material, such as the material described in connection with the retainer pads 70 or 70' above, and may have a suitable coating of washable material, as described above. The pad 114 and the shell 32 have suitable fastening means 116, such as the hook and loop strips discussed above, to releasably attach the pad 114 to the inside of the shell within the liner openings. The pad 114 may generally conform with the shape of the openings 62*a* and *b*, and may have a cutout 118 adjacent one end to facilitate removal of the pad 114 from the liner means. The upper pad 114 also serves to retain the liner means in its proper position within the shell 32, and to absorb energy from high level impacts against the helmet.

As best shown in FIGS. 1, 5 and 6, the upper ends of the retainer pads 70 are spaced from the annular members 54*a* and *b* of the first and second liners 52*a* and *b*, respectively, and define open regions 82 of the liner openings 60*a* and *b*. As shown, the ventilating openings 44 in the shell 32 communicate between the open regions 82 and the outside of the shell. Thus, air is permitted to circulate between the inside and the outside of the shell to ventilate the inside of the helmet while being worn.

As shown in FIGS. 1, 3, and 6, the rims 58*a* and *b* of the liner means 50 are spaced above the lower rear edge 40 of the shell 32. As shown in FIG. 17, an elongated rear sizer pad 84 is provided for placement in the lower rear portion of the shell. The pad 84 may be made of any suitable resilient material, such as the closed cell foam material described above in connection with the retainer pads 70 of FIG. 9, and may have a washable coating. The pad 84 preferably has a plurality of longitudinally spaced cutouts 86 to permit bending of the pad without wrinkling when placed in the shell. As shown in FIGS. 1, 3, and 6, the rear pad 84 is positioned below the liner means in the shell, and extends around a lower rear portion of the shell 32. The pad 84 may be releasably attached to the inner surface of the shell 32 by suitable fastening means 88, such as hook and loop strips, discussed above in connection with the pads 70, spaced longitudinally along the back surface of the pad and around the lower rear inner surface of the shell. Thus, the rear pad 84 is secured to the shell below the liner means 50 by pressing the pad against the shell to interengage the hook and loop strips of the fastening means 88. As shown, a lower portion of the rear pad 84 extends below the lower rear edge 40 of the shell 32. Thus, the pad 84 cushions the wearer's head and neck from an impact against a lower rear portion of the shell, and the lower portion of the pad 84 prevents the wearer's neck from engaging against the lower rear edge 40 of the shell. Since the rear pad 84 is normally in contact with the wearer's head or neck, the thickness of the pad may be selected or sized to the particular contour of a wearer's head, in order to provide a better cushioning effect against the shell.

Referring now to FIGS. 1, 2, and 6, the rims 58*a* and *b* of the first and second liners 52*a* and 52*b* are also spaced above the lower front edge 38 of the shell 32. As illustrated in FIG. 16, an elongated resilient front pad 90 is provided to cushion the wearer's head adjacent the lower front portion of the shell. The pad 90 may be made of any suitable material, such as the closed cell foam material described above in connection with the retainer pads 70. Also, the outer surface of the front pad 90 may be coated with a washable material, as previously described. As shown in FIGS. 1, 2, 6, and 16, the front pad 90 is releasably attached to the lower front portion of the shell by suitable fastening means 92, such as by hook and loop strips described above, with strips of the material being spaced longitudinally along the back surface of the pad 90 and the lower inner surface of the shell 32. Accordingly, the pad 90 is secured in place by pressing the pad against the lower front portion of the shell, such that the hook and loop sections or strips of the fastening means 92 interengage and retain the pad in place. In this configuration, the pad 90 is located below the liner means 50, and extends around the lower front portion of the shell, with a lower surface of the front pad 90 being located adjacent the lower front edge 38 of the shell. As shown, the pad 90 has a pair of depending tabs 94 adjacent its opposite ends, such that the tabs 94 cover a front inner portion of the ear protectors 42 of the shell 32. The thickness of the front pad 90 may be selected to conform with the particular size of the wearer's head, as described above in connection with the rear pad 84. Thus, the front pad 90 serves to absorb blows adjacent the lower front portion of the shell.

As shown in FIGS. 4 and 6, the helmet 30 has a sweat band 96 extending between the outside and the inside of the shell 32. The sweat band 96 may be made of any suitable material, such as a sheet of soft porous material which permits the transmission of water vapor through the sweat band. For example, the sweat band may be made from a poromeric polyvinyl chloride material having a reinforcement backing of woven material, such as a material sold under the trademark PORON by Rogers Corporation. As shown in FIGS. 1, 2, and 6, one end 100 of the sweat band 96 is received in an elongated U-shaped plastic retaining member 102, and the one sweat band end 100 and retaining member 102 are secured to the outside of the shell by suitable means, such as by a pair of spaced screws 104.

Referring now to FIGS. 11 and 12, the other end 106 of the sweat band has a pair of bifurcated tabs 108, with each of the tabs 108 having fastening means 110 for releasably attaching the tabs 108 to the fastening means 72 on the inside of the shell. The fastening means 110 comprises hook and loop strips which are compatible with the strips 74*b* on the inside of the shell, the latter being also utilized to secure the retainer pads 70 to the shell. As shown, the liner means 50 has aligned spoke members adjacent the front of the shell, with the fastening sections 74*b* under discussion being located in the liner openings on opposite sides of the front spoke members. As best shown in FIG. 12, the other end 106 of the sweat band 96 is secured in place by attaching the fastening means 110 of the tabs 108 to the fastening strips 74*b* on opposite sides of the front spoke members of the liner means. Next, a pair of retainer pads 70 may be positioned in the liner openings on opposite sides of the front spoke members, and are secured in place over the tabs 108 by interengaging the fastening sections 74*a* on the back surfaces of the retainer pads 70 against the fastening strips 74*b* on the inside of the shell 32. Thus, the pads 70 facilitate retention of the tabs 108 against the inside of the shell.

In this configuration, the sweat band 96 extends around the lower front edge 38 of the shell 32, the front pad 90, and the lower rims of the liner means 50, with the sweat band covering a portion of the front spoke members of the liner means, and with the tabs 108 of the sweat band 96 extending on opposite sides of the front spoke members. Accordingly, the sweat band 96 facilitates retention of the front pad 90 and the lower front portion of the liner means 50 in their proper place within the shell. As shown in FIGS. 6 and 11, the sweat band 96 also has a resilient pad 112 extending between the side edge of the sweat band, and being located intermediate the sweat band 96 and the lower front edge 38 of the shell 32. The pad 112 may be made of any suitable material, such as an open cell polyvinyl chloride foam. The pad 112 provides a cushion for the head over the lower front edge 38 of the shell Referring now to FIGS. 1, 2, 4, and 6, the helmet 30 has a pair of jaw pads 120 secured to the lower inner portion of the ear protectors 42 of the shell 32, with the lower surface of the jaw pads generally conforming with the lower edge of the ear protectors 42. The jaw pads 120 may be releasably attached to the ear protectors 42 by suitable fastening means 122, such as the hook and loop fasteners, discussed above, or male and female snap fasteners, as shown. Referring to FIGS. 13 and 14, the jaw pads 120 have an inner resilient pad 124 made of suitable material, such as open cell urethane foam. The pads 120 also have a front cover sheet 126 of a soft conformable material, such as a closed cell vinyl foam, and a back cover sheet 128 of suitable material, such as a sheet of vinyl, connected to the front sheet 126 adjacent sides of the pads 120. Thus, the front and back sheets 126 and 128 define an air chamber 130 covering the inner pad 124. As shown, the back sheet 128 has an opening 132, and the female fastener 134 of the fastening means 122 has an opening 136 extending through the fastener 134 and communicating with the opening 132 of the back sheet 128. Thus, air is permitted to pass through the fasteners between the chamber 130 and the outside of the jaw pads 120. Accordingly, the covered foam pads 124 are permitted to contract and expand during use of the helmet, and the fasteners 134 prevent the back sheet 128 from ripping or tearing around the back sheet openings 132.

Another embodiment of the fastening means 122 for the jaw pads 120 is illustrated in FIG. 15, in which like reference numerals designate like parts. In this embodiment, the fastening means 122 comprises a resilient fastening member 138. The fastening member 138 has a base 140 located inside the pad 120 behind the back sheet 128, and an enlarged outer head 142. Thus, the heads 142 of the fastening members 138 are passed through apertures 144 extending through the shell 32, until the heads 142 engage against the outer surface of the shell 32, and lock the jaw pads in place against the inner surface of the shell.

Referring now to FIG. 1, the helmet 30 also has a chin strap 146 to secure the helmet on the wearer's head. The chin strap 146 has a pair of retaining straps 148 and 150 which cross at lower space points to support a chin cup 152. As shown, ends of the straps 148 and 150 are slidably received in fastening elements 154 and 156, in order that the ends of the straps may be releasably secured to the outside of the shell at spaced locations to provide stability to the shell 32 when the helmet is worn. The distance between the chin cup 152 and the shell 32 may be modified by suitable adjustment of the straps 148 and 150 in the fastening elements 154 and 156.

Referring to FIGS. 19 and 20, the straps 148 and 150 may be secured together at the spaced crossing locations 158 and 160 by suitable means, such as by lines of sewing, and, the straps 148 and 150 are spaced apart in the region of the chin cup 152. The chin cup 152 has a sheet 162 of soft conformable material, such as the poromeric described above in connection with the sweat band 96, extending between the spaced portions of the straps 148 and 150 in the cup, As best shown in FIG. 21, the lateral side margins 164 of the sheet 162 are folded over to a location against the straps, and the straps are secured to the sheet 162 and its side margins 164 by suitable means, such as by lines of sewing. Thus, the sheet 162 has side edges 166 which extend past side edges 168 of the relatively stiff straps. Since the sheet 162 faces the wearer's skin, the side edges 166 of the sheet 162 define soft edges for contacting the wearer's chin and prevent the straps from cutting the wearer's skin during use of the helmet.

The helmet may be assembled in the following manner. The first liner 52*a* is positioned within the second liner 52*b*, and the nested liners 52*a* and *b* are placed in the shell, with one of the aligned spoke members being located adjacent the forward portion of the shell. Next, the front and rear pads 90 and 84 may be secured in place below the liners at the lower front and rear portions of the shell to temporarily retain the liners in their desired position within the shell. The other end 106 of the sweat band 96 may be passed around the front pad 90 and the lower hollow rims of the liners, and the bifurcated tabs 108 are secured to the inside of the shell on opposite sides of the front spoke members of the liners. Next, the retainer pads 70 are attached to the shell through openings 60*a* and *b* of the first and second liners 52*a* and *b* to retain the liners in the proper position within the shell, and the pad 114 may be attached to the shell through the upper openings 62*a* and *b* of the liner means. Finally, the jaw pads 120 may be secured to the inside of the ear protectors 42 of the shell 32.

The helmet may then be fitted to the particular size of the wearer's head. First, the inner first liner 52*a* may be inflated through the valve means 68*a* from the inside of the helmet prior to placing the helmet on the wearer's head. The extent to which the inner liner is inflated may depend somewhat upon the size of the head relative the shell. Next, the helmet is placed on the wearer's head, and the helmet is secured in place on the head through use of the chin strap 146. Finally, the second liner 52*b* is inflated through the shell opening 46 and the valve means 68*b* from the outside of the shell while the helmet is secured on the wearer's head by the chin strap 146 to obtain a proper fitting of the helmet on the head. Thus, the second liner is inflated until the inner surface of the first liner contacts the head in a comfortable manner. In this manner, the inflatable liner means 50 and helmet may be adapted to varying head sizes. Of course, the helmet may be removed and the first inner liner may be inflated an additional amount if necessary to obtain a proper fit.

Another embodiment of the helmet 30 is illustrated in FIG. 23, in which like reference numerals designate like parts. In this embodiment, the helmet includes resilient connecting members 170 extending between the retaining pads 70, with the members 170 being located intermediate the liner means 50 and the shell 32. Thus, the pads 70 and connecting members 170 define a resilient third liner 174 having cutout portions 172 to receive the first and second liners 52*a* and *b*. The third liner 174 may be conveniently made of one-piece construction, for example, by molding the liner from a polystyrene foam or a radiated polyethylene foam, such that the retaining pads 70 project into the liner openings intermediate the spoke members of the liner means 50. The third liner 174 may have suitable cutouts to receive the spoke members, the annular members, and the rims of the first and second liners, as desired. Thus, the third liner 174 retains the inflatable first and second liners in position within the shell, and confines expansion of the liner means intermediate adjacent pads, in a manner as described above. Of course, the connecting members 170 of the third liner 174 provide additional energy absorbing capacity for the helmet intermediate the liner means and the shell 32.

Figure 24:
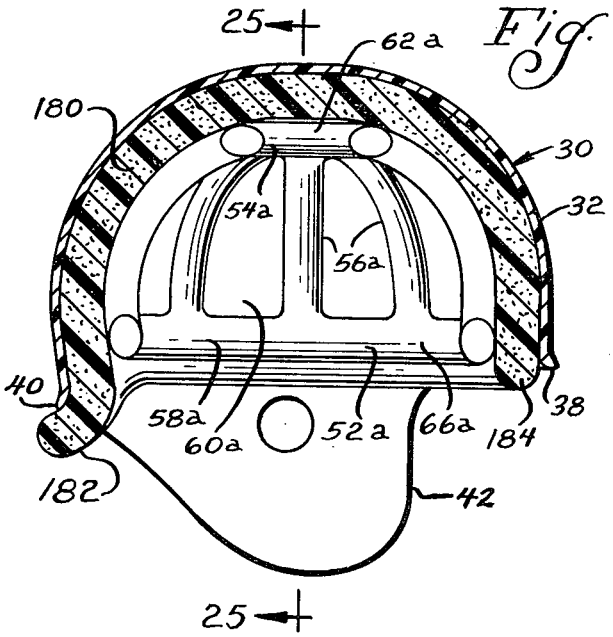
FIG. 24 is a side sectional view of another embodiment of a protective helmet.
Figure 25:
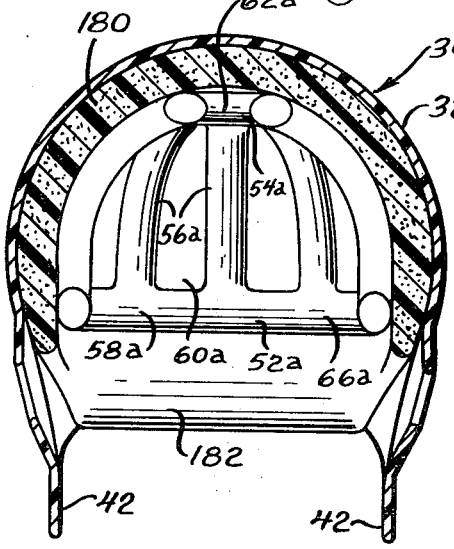
FIG. 25 is a sectional view taken substantially as indicated along the line 25—25 of FIG. 24.

Another embodiment of the helmet 30 is illustrated in FIGS. 24 and 25, in which like reference numerals designate like parts. In this embodiment, the helmet has a first inner liner 52*a* similar to that described above in connection with the helmets of FIGS. 1–23. Thus, the inner liner has a plurality of hollow spoke members 56*a*, a hollow annular member 54*a* communicating with the spoke members adjacent an upper central portion of the liner 52*a*, and a hollow rim 58*a* communicating with the spoke members 56*a* at a lower portion of the liner 52*a*. The helmet 30 also has a second resilient liner 180 positioned intermediate the first liner 52*a* and the shell 32, with a lower rear portion 182 of the liner 180 extending below the lower rear edge 40 of the shell 32. The liner 180 may be made from any suitable material, such as a layer of closed cell vinyl foam of medium range density. The second liner 180 may be releasably secured within the shell by suitable means, such as a hook and loop fastening arrangement, as described above. Also, the first inner liner 52*a* may be retained in place within the second liner 180 by any suitable means, such as the retainer pads, discussed above, which may be releasably attached to the second liner 180 through the openings 60*a* defined by the first liner 52*a*. If desired, the second liner 180 may have a plurality of projections extending into the openings of the first liner 52*a* to retain the first liner in place. Of course, the liners may be secured in the helmet by a number of other types of fastening means. The helmet may also have a sweat band extending around a front portion of the helmet, as described above, and a pair of jaw pads secured inside the ear protectors 42 of the shell 32. As shown, a lower portion 184 of the second liner 180 may be located adjacent the lower front edge 38 of the shell 32.

The first inner liner is preferably made of a relative soft material to provide a soft conformable inner surface 66*a* for contacting the wearer's head, and to absorb energy responsive to lower force levels applied against the helmet. The resilient second liner 180 assists the first liner 52*a* in dissipating forces, and primarily absorbs the energy responsive to higher level forces applied against the shell. The wearer's head is also protected adjacent the lower edges of the shell by the lower front and rear portions 184 and 182 of the second liner 180, as well as the rim 58*a* of the first liner 52*a*.

Figure 26:
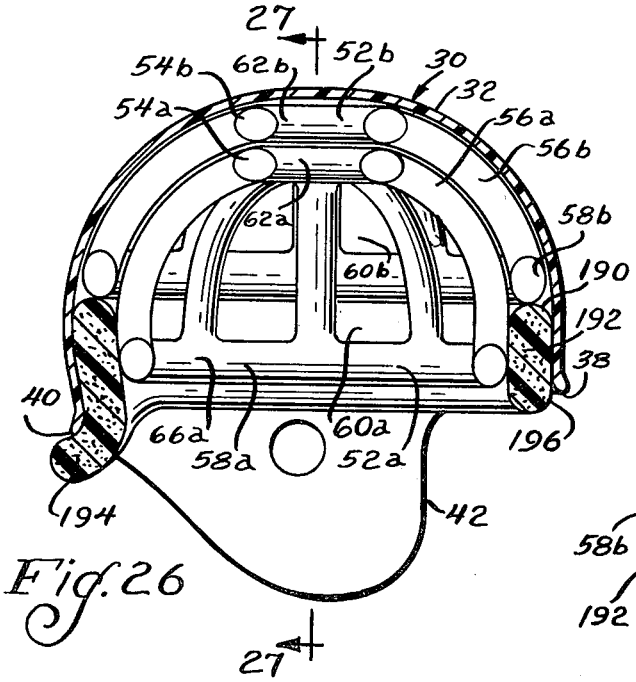
FIG. 26 is a side sectional view of another embodiment of a protective helmet.
Figure 27:
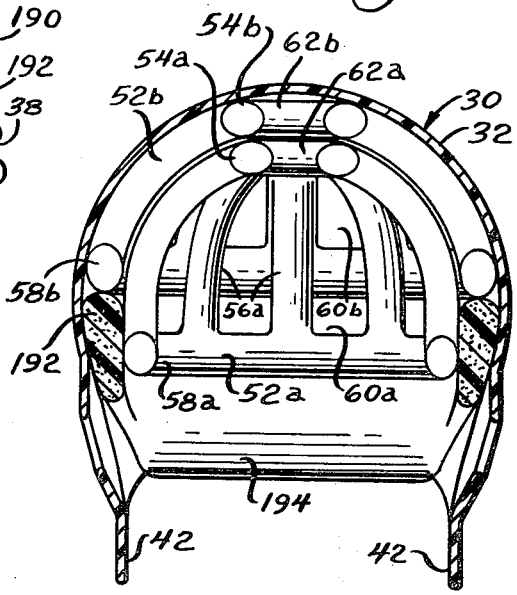
FIG. 27 is a sectional view taken substantially as indicated along the line 27—27 of FIG. 26.

Another embodiment of the helmet 30 is illustrated in FIGS. 26 and 27, in which like reference numerals designate like parts. In this embodiment, the helmet 30 has a pair of inflatable first and second liners 52*a* and 52*b* which are similar to the liners discussed above in connection with the helmets of FIGS. 1–23. As before, the first liner 52*a* may be made of a relatively soft material to provide a soft conformable inner surface 66*a* for contact with the wearer's head. The second liner 52*b* is positioned intermediate the first liner 52*a* and the shell 32, and may be made of a more rigid material to dissipate higher level forces applied against the shell. As discussed above, the first and second liners 52*a* and *b* have hollow annular members 54*a* and *b*, hollow spoke members 56*a* and *b* extending radially from the respective annular members 54*a* and *b*, and hollow rims 58*a* and *b* extending around a lower portion of the respective liner. However, in this embodiment, the rim 58*b* of the second liner 52*b* is spaced above the rim 58*a* of the first liner 52*a*, such that a space 190 is defined intermediate the lower portion of the first liner 52*a* and the shell 32, and below the rim 58*b* of the second liner 52*b*.

As shown in the drawings, the helmet 30 has a third resilient liner 192 positioned in the space 190 and extending peripherally around a lower portion of the shell 32. Thus, the third liner 192 is positioned beneath the rim 58*a* of the first liner 52*a*, and below the rim 58*b* of the second liner 52*b*. The third liner 192 may be made of any suitable material, such as a closed cell vinyl foam. The third liner 192 preferably has a lower rear portion 194 extending below the lower rear edge 40 of the shell 32 to protect the wearer from contact against the lower rear edge of the shell. The lower front portion 196 of the third liner 192 may be located adjacent the lower front edge 38 of the shell 32. As previously described, the helmet may have a pair of jaw pads secured to the ear protectors 42, a sweat band extending between inner and outer front portions of the helmet, and retainer pads extending through aligned portions of the liner openings 60*a* and *b* and the liner openings 62*a* and *b*. The third liner 192 may be secured to the inner surface of the shell by suitable fastening means, such as hook and loop arrangement between the third liner 192 and the shell, as previously described.

Thus, the first and second liners co-operate in a manner as previously described to dissipate forces of varying levels which may be applied against the shell. Also, the third resilient liner 192 co-operates with the lower portion of the first liner 52*a* to absorb energy responsive to impacts against the shell, particularly at the lower portion of the shell. At the same time, the inner liner 52*a* provides a comfortable surface for the wearer during use of the helmet.

The foregoing detailed description is given for clearness of understanding only, and no unnecessary limitations should be understood therefrom, as modifications will be obvious to those skilled in the art.

We claim:

1. A protective helmet, comprising: a relatively rigid shell, a first inner liner of flexible material having a crown portion located adjacent an upper central part of said shell for overlying a wearer's head, side portions extending radially from said crown portion toward a lower part of the shell for overlying opposed sides of the wearer's head, fluid filled chamber means comprising only one chamber extending through said crown portion into said portions and being sufficiently free of obstruction to permit relatively unimpeded passage of fluid between said crown and side portions, said first liner having a relatively soft inner surface for contacting the wearer's head, and said helmet having a second liner of resilient material positioning intermediate the first liner and said shell.

2. The helmet of claim 1 wherein the second liner covers a substantial portion of an inner surface of said shell.

3. The helmet of claim 1 wherein said second liner comprises a foam material.

4. The helmet of claim 1 wherein said second liner comprises a closed cell foam material.

5. The helmet of claim 1 wherein said second liner comprises a vinyl foam material.

6. The helmet of claim 1 wherein the chamber means of the first liner is inflated with a gas.

7. The helmet of claim 1 wherein said first liner has a shore A hardness in the range of 45 to 55.

8. The helmet of claim 1 wherein the first liner has a plurality of hollow spoke members extending radially from an upper central portion of the first liner.

9. The helmet of claim 8 wherein the first liner has a hollow annular member communicating with the spoke members adjacent an upper central portion of the first liner.

10. The helmet of claim 8 wherein the first liner has a hollow rim extending at least partially around the shell and communicating with the spoke members adjacent a lower portion of the first liner.

11. The helmet of claim 1 wherein the second liner includes a lower portion extending below a back edge of the shell.

12. A protective helmet, comprising:

a shell;

a first inner liner of flexible material having first fluid filled chamber means;

a second liner of flexible material positioned intermediate the first liner and said shell and having second fluid filled chamber means at least partially located intermediate the first chamber means and said shell, said second liner having a lower end spaced above a lower end of the first liner at least partially around the shell; and a third liner of resilient material positioned intermediate the lower end of the first liner and said shell, with said third liner extending at least partially around the shell in the space defined below the second liner.

13. The helmet of claim 12 in which the lower end of the second liner is spaced from the lower end of the first liner at least substantially around a lower portion of the shell.

14. The helmet of claim 13 in which the third liner extends at least substantially around the shell.

15. The helmet of claim 12 in which the third liner comprises a foam material.

16. The helmet of claim 12 in which the third liner comprises a closed cell foam material.

17. The helmet of claim 12 in which the third liner includes a lower portion extending below a lower back edge of the shell.

18. The helmet of claim 12 wherein the first and second liners include a hollow rim adjacent the lower end of the respective liner and extending at least substantially around said shell, with the rim of the second liner being spaced above the rim of the first liner.

19. The helmet of claim 12 wherein the first and second liners have a plurality of hollow spoke members extending radially from an upper central portion of the respective liner, with the spoke members of the first liner being generally aligned with the spoke members of the second liner.

20. The helmet of claim 18 wherein first and second liners have a plurality of hollow spoke members extending radially from an upper central portion of the respective liner, with the spoke members of the first liner being generally aligned with the spoke members of the second liner, and in which the spoke members of the first and second liners communicate with the respective rim adjacent a lower end of the respective liner.

21. The helmet of claim 19 in which the first and second liners include a hollow annular member communicating with the respective spoke members adjacent an upper central portion of the respective liner.

22. The helmet of claim 12 wherein said second liner is less deformable than the first liner responsive to a given force level applied against the helmet.

23. A protective helmet, comprising:

a shell;

liner means positioned in the shell and having first fluid filled chamber means and second fluid filled chamber means at least partially located intermediate the first chamber means and said shell, with an outer lower part of said liner means being spaced above an inner lower part of the liner means, and with said inner part of the liner means including at least a portion of said first chamber means; and a liner of resilient material positioned intermediate the inner lower part of the layer means and said shell below the outer lower part of the liner means.

24. A protective helmet, comprising:

a shell;

liner means positioned in the shell and having an upper part defining first and second fluid filled chamber means, with the second chamber means being located intermediate the first chamber means and said shell, and a lower part spaced from the shell and having a fluid filled chamber means extending at least partially around a lower portion of the shell; and a liner of resilient material positioned intermediate said lower part of the liner means and said shell.

25. The helmet of claim 24 wherein the chamber means of said lower part of the liner means communicates with the first chamber means of said upper part of the liner means.

* * * * *

UNITED STATES PATENT AND TRADEMARK OFFICE

CERTIFICATE OF CORRECTION

PATENT NO. : 3,994,022

DATED : November 30, 1976

INVENTOR(S) : Frank K. Villari and Carl J. Steigerwald

It is certified that error appears in the above-identified patent and that said Letters Patent are hereby corrected as shown below:

Column 2, line 6, "adsorbing" should read -- absorbing --.

Column 6, line 4, "spaces" should be -- spaced -- .

Column 10, line 55, "the", second occurrence, should be -- their -- .

Column 12, line 2, after "lower" insert -- front -- .

Column 12, line 5, "relative" should be -- relatively -- .

Column 12, line 59, after "as" insert -- a -- .

Column 13, line 21, "positioning" should be -- positioned -- .

Column 13, line 49, after "a", second occurrence, insert -- lower -- .

Signed and Sealed this

Fifth Day of April 1977

[SEAL]

*Attest:*

RUTH C. MASON
*Attesting Officer*

C. MARSHALL DANN
*Commissioner of Patents and Trademarks*